United States Patent [19]

Miller

[11] 4,145,908

[45] Mar. 27, 1979

[54] INCREMENTAL HOT SIZING OF TITANIUM

[75] Inventor: John C. Miller, Des Moines, Wash.

[73] Assignee: Boeing Commercial Airplane Company, Seattle, Wash.

[21] Appl. No.: 838,444

[22] Filed: Oct. 3, 1977

[51] Int. Cl.[2] ..... B21J 1/06

[52] U.S. Cl. ..... 72/342; 148/131

[58] Field of Search ..... 148/11.5 F, 130, 131; 29/DIG. 21, DIG. 45; 72/DIG. 12, DIG. 13, 342, 364

[56] References Cited

U.S. PATENT DOCUMENTS

| | | | |
|---|---|---|---|
| 233,463 | 10/1880 | Bakewell | 72/364 |
| 3,094,160 | 6/1963 | Walton et al. | 72/364 |
| 3,528,276 | 9/1970 | Schmidt et al. | 72/342 |

*Primary Examiner*—Lowell A. Larson

*Attorney, Agent, or Firm*—Bernard A. Donahue; Morris A. Case

[57] ABSTRACT

Titanium is advanced by increments through a heated pressurized die to yield a sized stress relieved part. Temperature zones are controlled across the die. Titanium as it advances in steps through the die allows time for soaking at forming temperatures and provides for advancement in steps to control outlet temperatures.

10 Claims, 4 Drawing Figures

INCREMENTAL HOT SIZING OF TITANIUM

BACKGROUND OF THE INVENTION

Hot sizing of a long titanium part with a fully enclosing die requires either a very costly metal die or a ceramic tool that is difficult to fabricate to close tolerances and has a relatively short service life. Either fully enclosing tool requires an integral heat source along its length or a high temperature furnace long enough to enclose the tool. The time cycle for forming an elongated titanium part within the die often takes up to 24 hours as tool with part must be brought up to hot sizing temperature, soaked at temperature to stress relieve the titanium and then cooled down before the part can be removed. U.S. Pat. No. 3,025,905 shows that a short titanium part may be heated to hot forming temperature, soaked at that temperature to stress relieve, and removed from the die while at the forming temperature. It is known to hot form elongated metal parts by increments in a short die by opening the die, inserting the part into the die, applying temperature and pressure to bring the part up to hot sizing temperatures, opening the die, advancing the part and repeating the cycle until the length of the part has been formed. Even though this works on many metals, it did not work on titanium parts as the titanium warped beyond acceptable tolerances. It was found that elongated titanium parts can be incrementally formed, within tolerances, by following the teaching of this invention.

SUMMARY OF THE INVENTION

The temperature gradient along the length of a forming die is carefully controlled with an area or section having temperatures within the hot sizing range for hot forming and stress relieving of titanium, and extending from this hot forming zone to the outlet end of the die is an area or section having a temperature gradient that sharply decreases down to a temperature well below the hot sizing range. An elongated titanium part moves incrementally through the die in increments of a length providing constraint and a heat sink for controlling temperatures of the part as it passes beyond the die.

DETAILED DESCRIPTION

Figure 4:
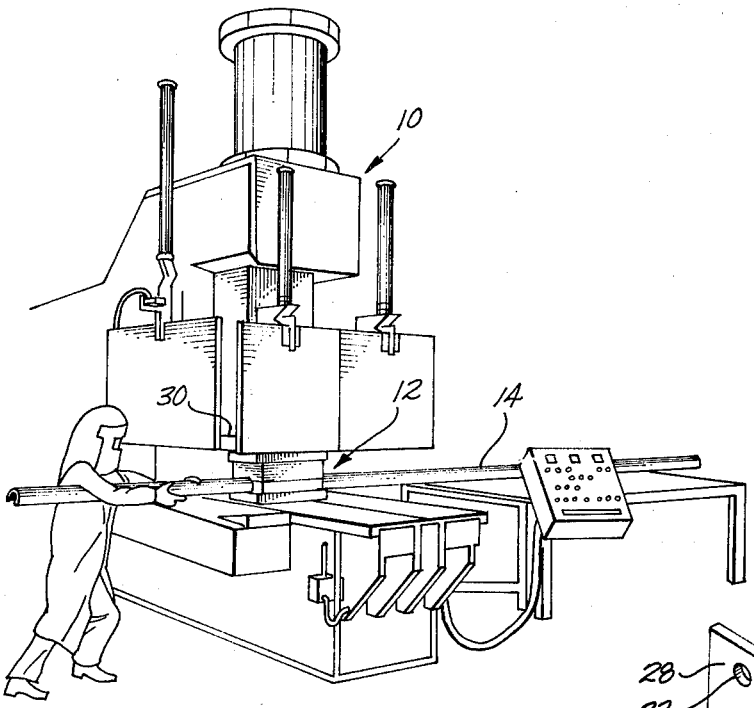
FIG. 4 shows a perspective view forming the part of FIG. 1 using a hot forming press.
Figure 3:
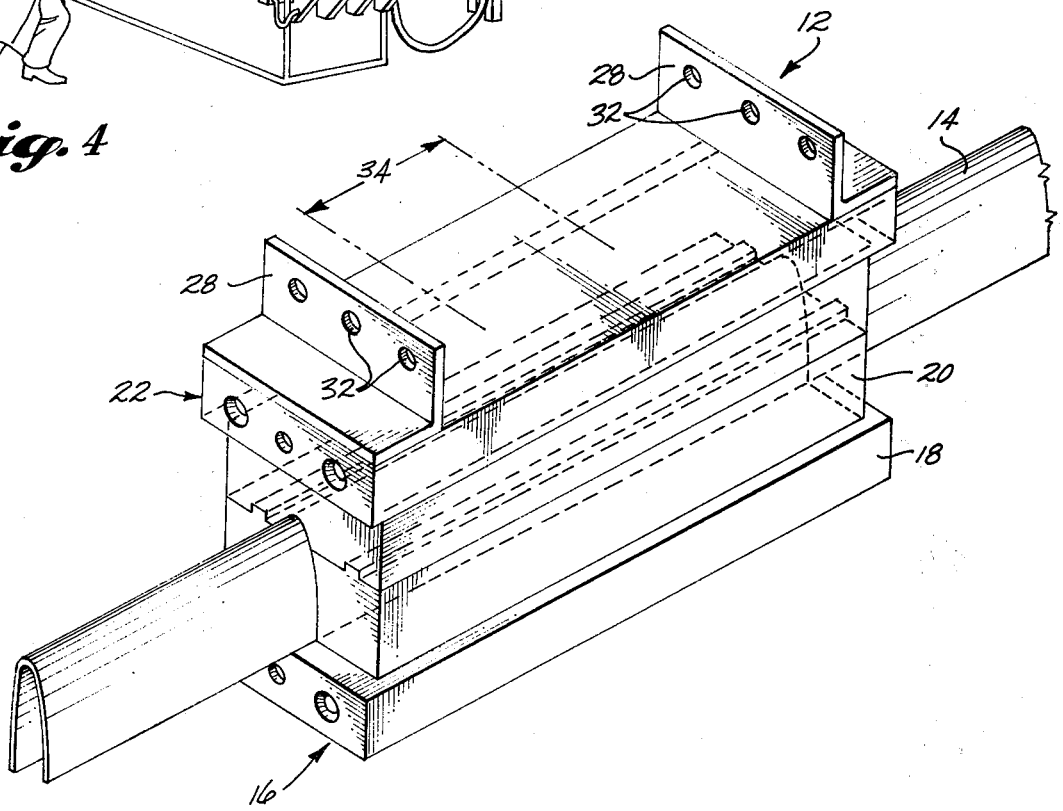
FIG. 3 shows an enlarged perspective view of the die with positioned part.

In FIG. 4 a hot sizing press 10 is used to provide heat and pressure to a die 12 for forming a titanium part 14 to a controlled contour. The die is in two parts with the lower part 16 made up with a base 18 and a contoured male part 20 while the upper part 22 has a base 24 and a contoured female part 26. The upper part of the die also has an angle iron 28 located near each end, and fastened to the die, with the angle iron used to attach the upper part of the die to a platen 30 by use of fasteners, not shown, through the holes 32. The press may then be used to raise and lower the die to permit advancing the titanium through the die.

Figure 1:
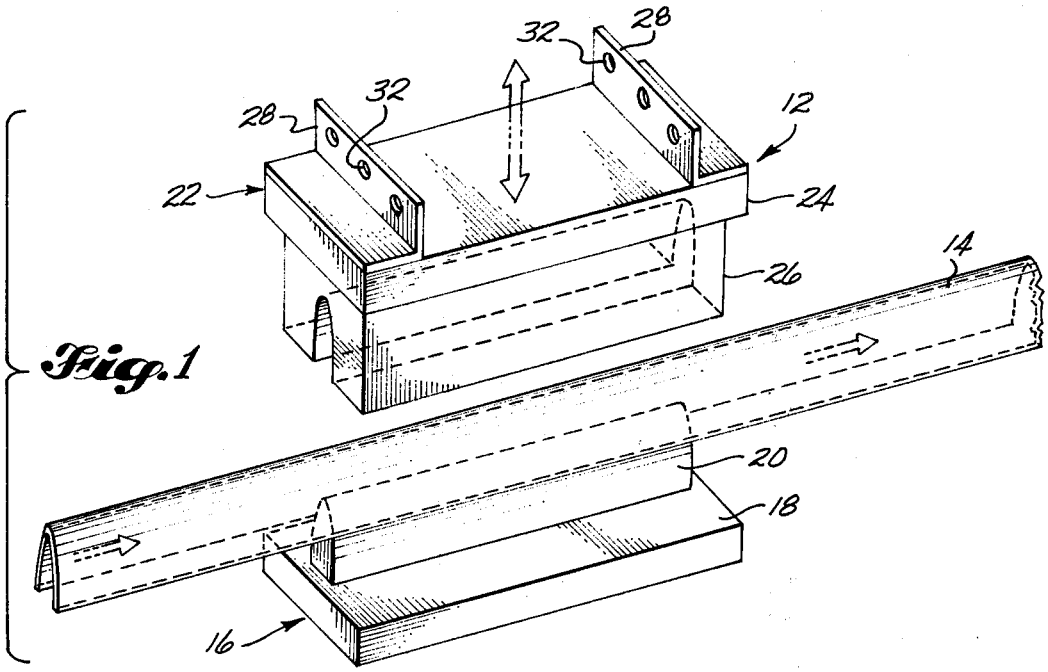
FIG. 1 shows an exploded perspective view of a die fragmented part for practicing this invention.
Figure 2:
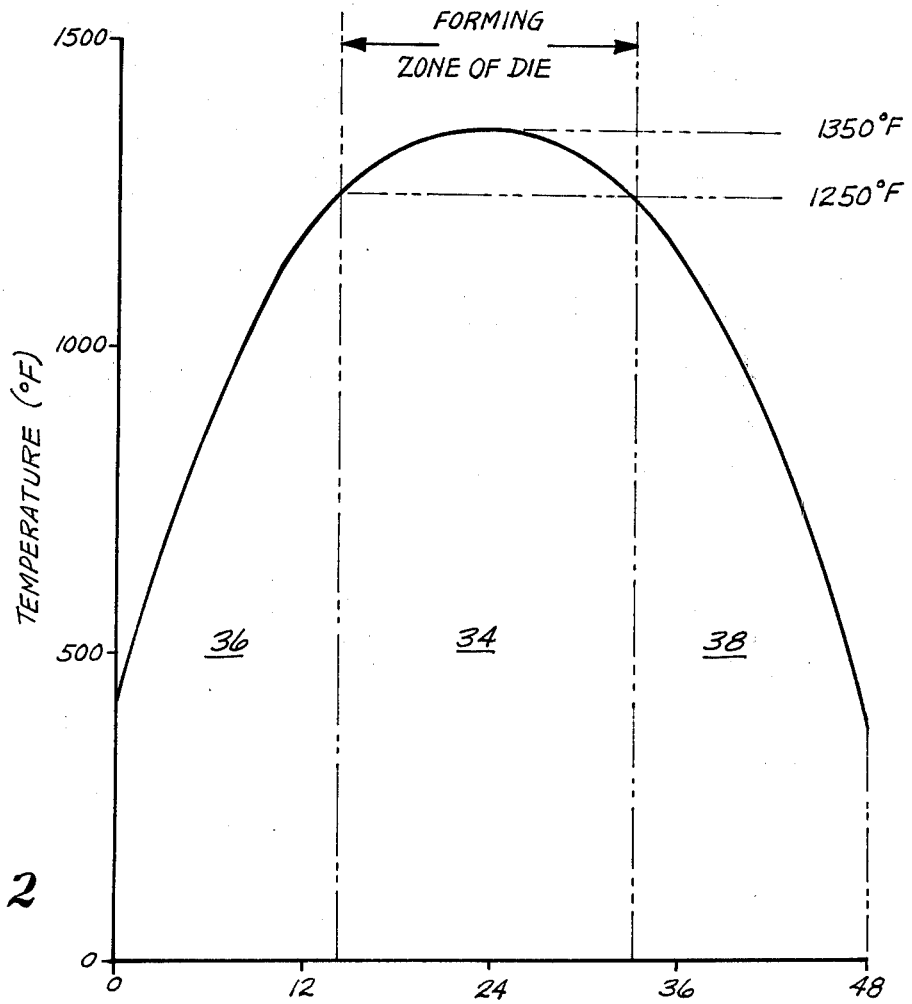
FIG. 2 shows a graph of distance versus temperature along the length of the die of FIG. 1.

In operation, the die 12 is opened and closed at intervals so that the part 14 can be heated, hot sized and cooled in incremental stages or steps. After hot sizing one increment, the part is advanced one increment of length when the die is opened, and the hot sizing and advancing repeated until the full length of the part has been hot formed. When a part is being formed, the temperature gradient across the length of the die must be controlled. In the temperature gradient as shown in the graph of FIG. 2, the middle section of the die is a forming zone 34 at a hot sizing temperature, the inlet section 36 has a fast rising temperature gradient up to the forming zone temperature, and the outlet section 38 a sharply decreasing temperature from the forming zone down to the outlet of the die. Each incremental length of the titanium is soaked, while under pressure, at the hot sizing temperature for a time sufficient to form and to stress relieve the titanium. The term titanium as used here includes titanium alloys such as, but not limited to, Ti-6Al-4V, one of the better structural alloys. The length of each increment of advancement of the part is such as to constrain and provide a heat sink within the die for an advancing segment of the titanium that is at hot sizing temperature. FIG. 2 shows a preferred temperature gradient along the die with inlet and outlet temperatures at 400° F. and the hot sizing temperature at between 1250° F. and 1350° F. In this embodiment a four foot long die, and this length is not critical, had a 20 foot long titanium part, which was pre-formed in a cold brake, inserted about 30 inches into the die and the die closed with full press pressure. A soaking period of about 10 minutes was used to accomplish the hot sizing, and the part was advanced in increments of about a foot between each soaking period.

Even though it is preferable to have a sharply rising temperature gradient in the inlet section 36 of the die 12, it is not absolutely essential. This may alternately be a slowly rising temperature or the whole area of section 36 may be at hot sizing temperature.

It would be readily understood by those skilled in the art that the dies 12 may be integrally heated. When used in a hot sizing press 10, the platens 30 will be heated and the ends of the die 12 located with respect to the platens to obtain the desired downward temperature gradient in the outlet section 38 of the die before fastening the die to the platen.

What is claimed is:

1. A method of hot forming an elongated titanium member in a heated and pressurized die shorter than the elongated member, the steps comprising: heating and maintaining a hot forming temperature zone within a die; heating and maintaining a sharply downward temperature gradient from the forming zone to an outlet end of the die; advancing a titanium member through the die in steps by selecting increments of time sufficient for hot forming and stress relieving, and by selecting increments of advancement of a length providing a constrained heat sink.

2. A method of hot forming an elongated titanium member as in claim 1, steps further comprising: heating and maintaining a sharply rising temperature gradient from an inlet end of the die to the forming zone.

3. A method of incrementally hot sizing titanium, the steps comprising: utilizing a heated and pressurized die open ended to permit advancing a titanium part through the die, establishing and maintaining a temperature gradient across the die with a section at hot forming temperatures and a section having sharply decreasing temperatures extending from the hot forming section toward an outlet end of the die, soaking the titanium by increments in the hot forming temperature section for a time for each increment sufficient for sizing and stress relieving, and advancing the titanium through the die after each soaking with an increment of advancement limiting titanium at hot forming temperature to constraint within the die.

4. A method of incrementally hot sizing titanium as in claim 3 with steps further comprising limiting the hot forming temperature section to the middle of the die, and establishing and maintaining a sharply rising temperature section extending from the inlet to the hot forming section.

5. A method of incrementally hot sizing titanium as in claim 3, with steps further comprising: controlling the temperature gradient from about 1250° F. to 1350° F. in the hot forming temperature section, and decreasing down to between 400° F. and 500° F. at the outlet to the die.

6. A method of incrementally hot sizing titanium as in claim 4, with steps further comprising controlling the temperature gradient from between 400° F. and 500° F. at the die inlet and outlet and from about 1250° F. to 1350° F. in the hot forming temperature section.

7. A method of incrementally hot sizing titanium in a two part die operating in a hot sizing press, the steps comprising: placing a two piece die between platens of a hot sizing press and locating the die for obtaining a rapid temperature drop from a hot sizing temperature within the die to the outlet of the die when in a forming cycle; fastening the upper part of the die to the upper platen; setting the temperature of the press platens for imparting, to the die, a hot sizing temperature for titanium; advancing a titanium part through the die in steps; applying pressure and soaking at hot sizing temperature for a time sufficient to form and stress relieve the titanium in each step; and controlling the length of advancement in each step for reducing the temperature of the titanium to a point well below hot sizing temperatures before leaving the outlet of the die.

8. A method of incrementally hot sizing titanium as in claim 7, steps further comprising: controlling temperature gradient within the die at about 1250° F. to 1350° F. for the forming area and between 400° F. and 500° F. at the outlet to the die, and soaking each step for about 10 minutes.

9. A method of incrementally hot sizing titanium as in claim 7, steps further comprising locating the die with respect to the platens for obtaining a rapid temperature rise from the inlet of the die to the hot sizing temperature within the die with in the forming cycle.

10. A method of incrementally hot sizing titanium as in claim 9, steps further comprising controlling the temperature gradient within the die at about 1250° F. to 1350° F. for the forming area and between about 400° F. to 500° F. at the inlet and the outlet to the die, and soaking each step for about 10 minutes.

* * * * *